United States Patent [19]

Collins

[11] 3,939,954

[45] Feb. 24, 1976

[54] CHECK RECEIVING AND TESTING APPARATUS

[75] Inventor: Terence John Collins, Schaumburg, Ill.

[73] Assignee: Qonaar Corporation, Elk Grove Village, Ill.

[22] Filed: Mar. 18, 1974

[21] Appl. No.: 451,890

[52] U.S. Cl. ..... 194/102; 133/8 R; 194/DIG. 15

[51] Int. Cl.[2] ..... G07F 3/02

[58] Field of Search ..... 133/3, 8; 194/1 C, 1 E, 194/9, 97–102, 61–66, 70, DIG. 15

[56] References Cited

UNITED STATES PATENTS

| | | | |
|---|---|---|---|
| 2,903,117 | 9/1959 | Kowaleski et al. | 194/102 X |
| 3,125,102 | 3/1964 | Bower | 133/8 R X |
| 3,163,169 | 12/1964 | Rau | 133/8 R X |
| 3,738,469 | 6/1973 | Prumm | 194/101 |
| 3,752,168 | 8/1973 | Bayha | 133/3 H X |
| 3,788,440 | 1/1974 | Propice et al. | 194/99 |

*Primary Examiner*—Robert B. Reeves
*Assistant Examiner*—Francis J. Bartuska
*Attorney, Agent, or Firm*—McDougall, Hersh & Scott

[57] ABSTRACT

An apparatus for receiving checks including coins and the like whereby checks deposited in fareboxes or similar mechanisms can be inspected by detecting means for recording the value of the checks and for determining the authenticity of the checks. The apparatus particularly includes a movable disc and adjacent wall arrangement for separating checks one from the other when the checks are deposited in a manner such that one or more checks is held in overlying relationship with another check. The separating arrangement comprises a first surface on the disc, which may define friction means, for engaging the side of a check with an opposed surface of the wall being provided in the apparatus for engaging the side of a check stacked against the other check. A drive is provided for achieving relative movement between the surfaces whereby the check engaged by one surface will be moved away from the check engaged by the other surface to automatically eliminate the stacked relationship. At the same time, the checks are moved against a ramp which serves as a reference point for an electronic device so that each check will be individually observed by the detecting device even though several checks may be deposited simultaneously.

35 Claims, 11 Drawing Figures

CHECK RECEIVING AND TESTING APPARATUS

This invention relates to an apparatus for receiving checks and for observing the checks with suitable detecting means for recording the value of the checks and/or the authenticity of the checks. The invention finds particular application in vending structures for goods and services, for example fareboxes utilized in public transportation systems.

In constructions which are adapted to receive coins, tokens or other checks, it is desirable to provide means for recording the value of the checks, and for determining the authenticity of the checks. The recording mechanisms are preferably such that an individual deposit can be recorded, such as the deposit of a fare by a single passenger, while also recording accumulated deposits. In the course of determining amounts deposited, the detecting means are preferably suitable for determining whether the size or shape of a check deposited conforms with known standards so that spurious checks will not be credited to the individual depositing them or accumulated as a part of a total deposit. Particularly in the case of transit systems, suitable means for detecting and recording are desirable since personnel should be able to determine whether a proper fare has been deposited. In addition, the provision of means for recording accumulated amounts serves as a safeguard against pilfering since the recorded amounts should agree with a later count of proceeds.

In the case of transit systems and also with respect to other applications, rapid detection and recording is desirable particularly where one passenger after another deposits a fare in rapid sequence. In the absence of suitable detecting and recording means, personnel in charge may be forced to accept fares deposited without question, or the movement of passengers would be delayed so that each deposit could be properly checked.

One recognized deficiency in existing collection systems relates to the inability of the systems to accurately and rapidly accept a plurality of checks simultaneously. Thus, in a transit system, if a passenger should deposit a handfull of checks, as is often the case, the checks may stack one on the other, making observation by visual or other detecting means difficult or impossible. To applicant's knowledge, only relatively slow and otherwise unsatisfactory means have been available for handling the checks in a fashion such that they can be rapidly and accurately observed for detection and recording purposes.

It is a general object of this invention to provide an improved structure for the collection of checks in fareboxes and the like.

It is a more specific object of this invention to provide a check collection apparatus which includes improved means for detecting and recording checks deposited whereby an accurate determination of amounts deposited can be achieved.

It is a further object of this invention to provide a check collection system of the type described which is extremely reliable while operating at a very rapid rate and which in addition to a recording function is adapted to detect checks of a spurious character.

These and other objects of this invention will appear hereinafter and for purposes of illustration, but not of limitation, specific embodiments of the invention are shown in the accompanying drawings in which.

The apparatus of this invention generally comprises a structure for receiving checks such as coins or tokens, for example of the type utilized for the payment of fares in transit operations. The invention is more specifically concerned with detecting means which inspect the checks for purposes of determining the authenticity thereof and/or for purposes of recording the amount deposited.

In order to provide for rapid and reliable detection of the checks, the apparatus of the invention provides separating means which comprise a first engaging surface for engaging one side of each check deposited. A second engaging surface is positioned in spaced relationship with the first surface and a side of each check deposited is engaged by this second surface. Means are provided for driving at least one of the surfaces so that relative movement between the respective surfaces is achieved. The surfaces are adapted to grip the check faces engaged, for example through the provision of friction means on the surfaces, whereby a driving movement will be imparted to each check by one surface relative to the other surface. This arrangement results in the unstacking or "un-shingling" of checks which may initially be located in overlying relationship. This relationship will particularly occur where a passenger or other user of the apparatus deposits several checks simultaneously.

By eliminating any overlying relationship, the checks are adapted to be moved one at a time past detecting means for achieving the aforementioned functions. With the mechanisms of this invention, the separating of the checks and movement past detecting means is accomplished at a high rate of speed so that recording of the amount deposited and a determination of the authenticity of the checks deposited is carried out almost instantaneously. The mechanism of the invention, therefore, avoids delays in operation while permitting a determination by operating personnel whether a correct fare has been deposited. A highly reliable record of the accumulated amounts deposited is also achieved.

The check engaging surfaces utilized preferably comprise a rotating disc having a "rug-like" surface for effectively engaging the checks. This disc is movable opposite a stationary surface which may be formed of a hard rubber material or comparable synthetic material whereby the aforementioned separating movement is achieved. The rotating disc is also provided with a central hub with the drive movement automatically holding each check in engagement with this hub. A tangentially positioned take-off ramp is provided with the drive movement again insuring that each check is held against this ramp. This arrangement automatically provides a consistent reference point whereby detecting means such as a combination of light emitting and light receiving elements can be employed for rapid analysis of the check moving past the detecting means.

Figure 1:
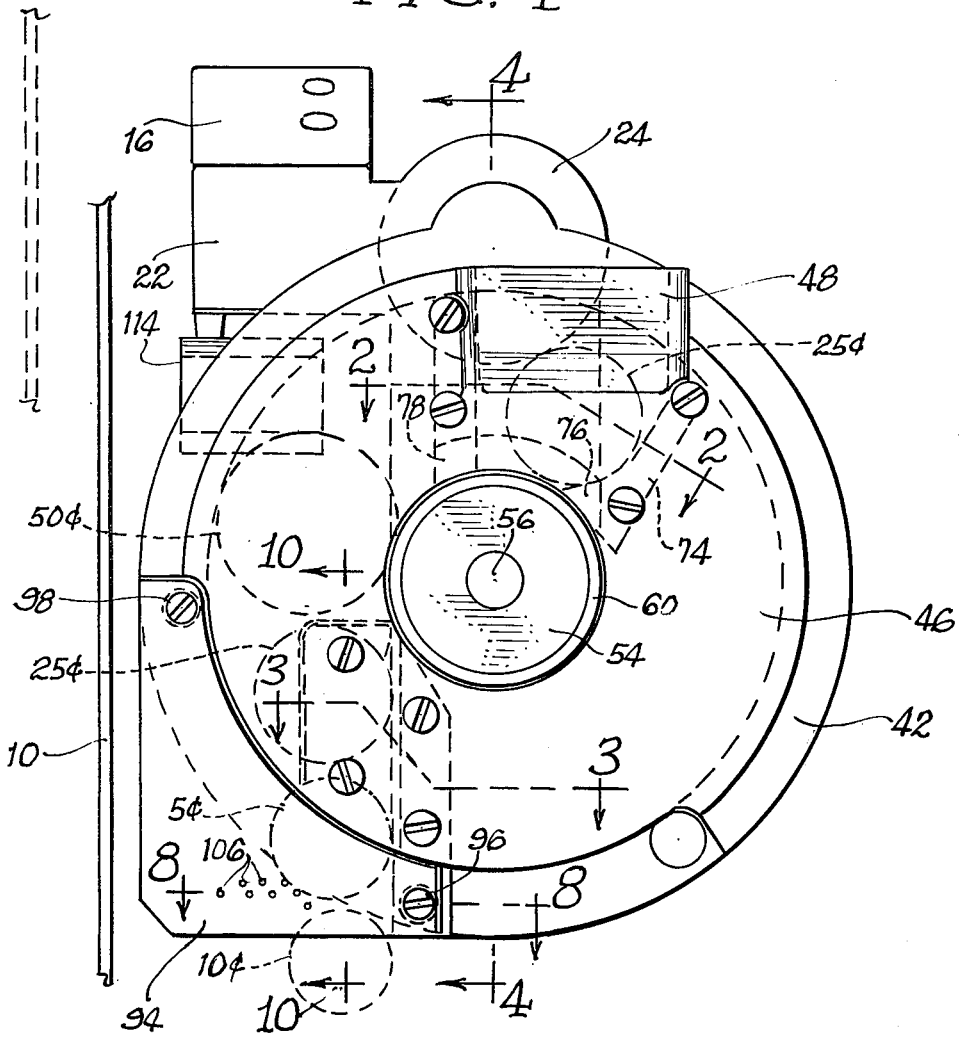
FIG. 1 is an elevational view of a check receiving mechanism characterized by the features of this invention.
Figure 2:
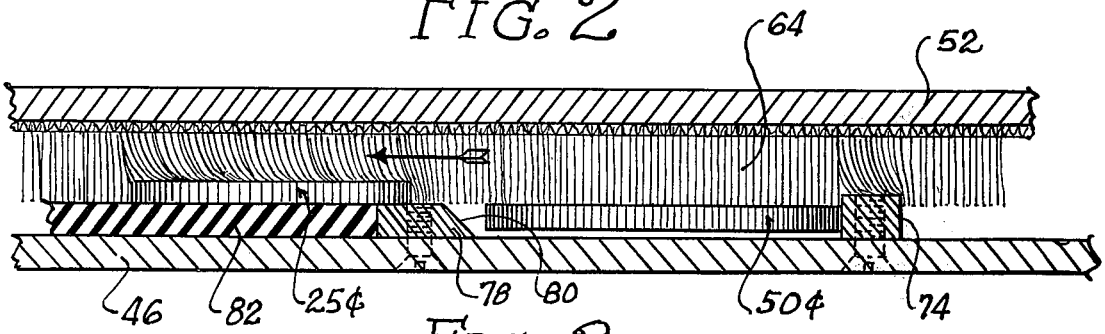
FIG. 2 is an enlarged fragmentary cross-sectional view taken about the line 2—2 of FIG. 1.
Figure 4:
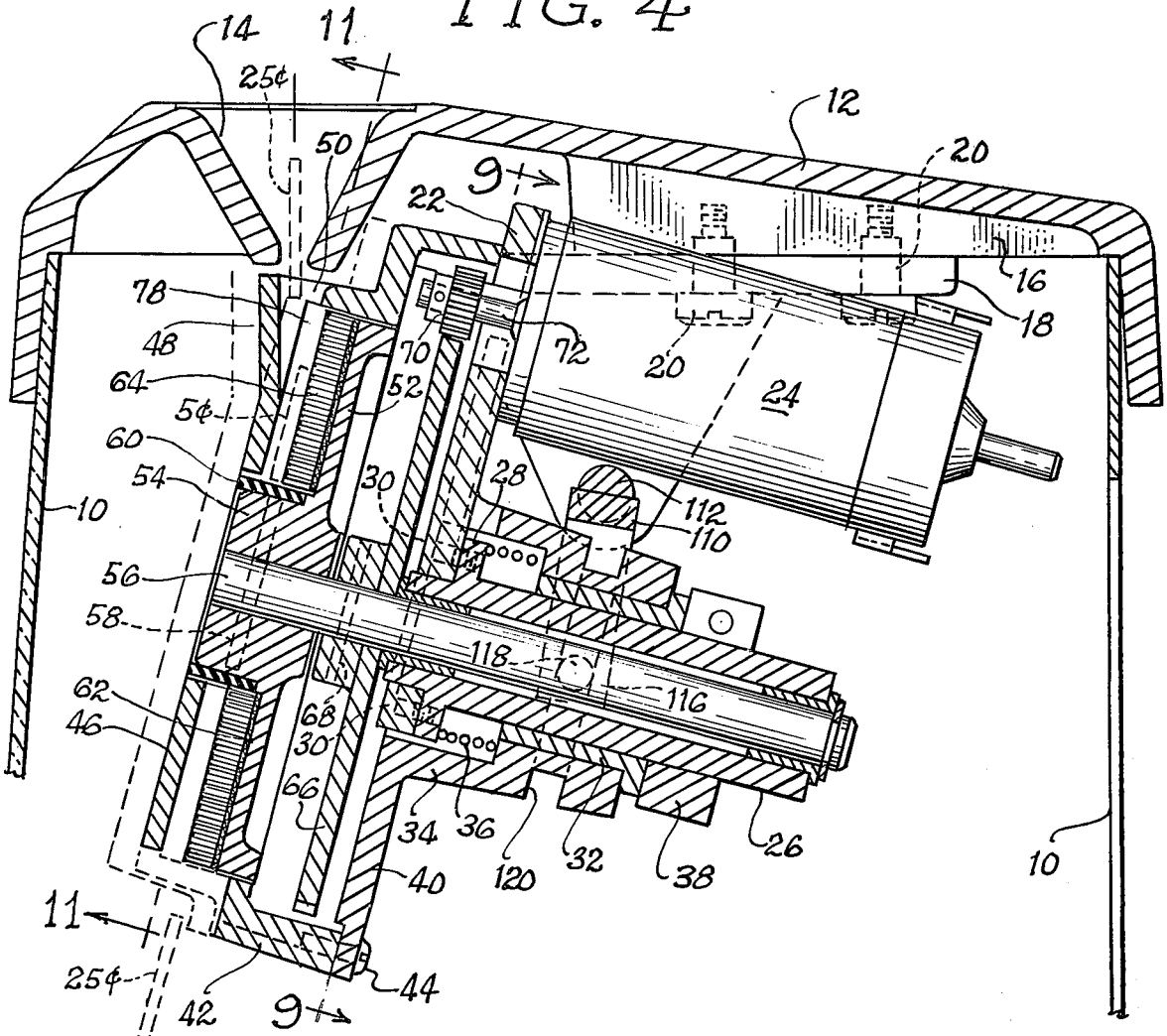
FiG. 4 is an enlarged vertical, sectional view of the check receiving mechanism taken about the line 4—4 of FIG. 1 and including a cross-sectional view of surrounding housing portions.

FIGS. 1 and 4 best illustrate the assembly of parts which make up the apparatus of the invention. This apparatus is shown in association with a housing which includes a vertically positioned wall 10 and a top wall 12 fitted onto the vertical wall. The walls 10 and 12 may comprise parts of a farebox with a check receiving throat 14 being provided for the introduction of checks which are illustrated in various positions in the respective figures.

The top wall 12 defines an inner section 16 which serves to support a bracket 18 connected to the section 16 by means of fasteners 20. This bracket includes an angularly disposed plate section 22, and a motor 24 is supported on this plate section.

A sleeve 26 defines a flange 28 which serves as a means for attaching the sleeve to the bracket plate 22 by means of fasteners 30. The sleeve supports a slideable bearing 32 which is press fit into the hub 34. A spring 36 is inserted between the flange 28 and a shoulder portion of the hub to normally hold the hub and associated bearing in spaced relationship with the flange as illustrated in FIG. 4. An adjustable collar 38 is secured to the sleeve to set the normal spaced relationship of these members.

The hub 34 is provided with a wide rim section 40 which serves as a mounting means for the housing 42, this housing being attached to the rim by means of fasteners 44. The housing 42 defines a wall 46 including a bent section 48 positioned adjacent the throat 14 in the top wall 12. The housing 42 is provided with an opening 50 adjacent this bent section for the passage of checks from the throat 14 inwardly between the wall 46 and the surface of the oppositely disposed disc 52.

The disc 52 defines a central hub 54 with a shaft 56 being secured in the opening defined by the hub by means of pin 58. A sleeve 60, which may be formed of gum rubber, is secured around the outer periphery of the hub by means of press fitting, an adhesive or the like. The inner surface 62 of the disc 52 carries a rug-like material 64 with the pile thereof extending perpendicularly relative to the disc surface. This rug may, for example, comprise a sheet of polyvinyl chloride having the fingers molded integrally thereon with a linen backing provided for the sheet to facilitate attachment.

A gear 66 is also attached to the shaft 56 by means of pin 68. This gear meshes with drive pinion 70 which is mounted on the drive shaft 72 of motor 24. The motor 24 may comprise a synchronous electric motor or any comparable drive means adapted to be repeatedly actuated and operated at a set speed.

Figure 3:
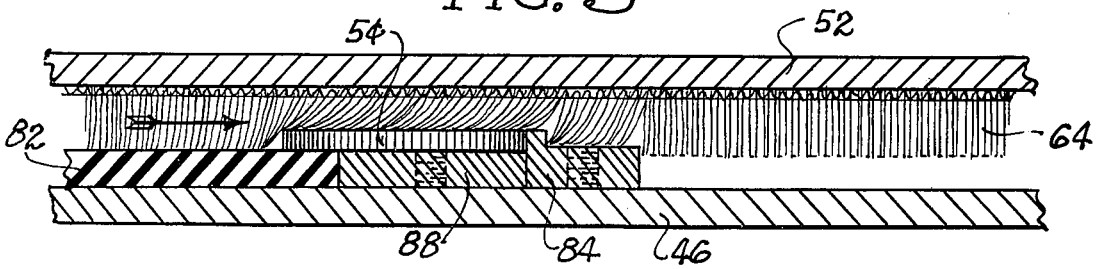
FIG. 3 is an enlarged fragmentary cross-sectional view taken about the line 3—3 of FIG. 1.
Figure 11:
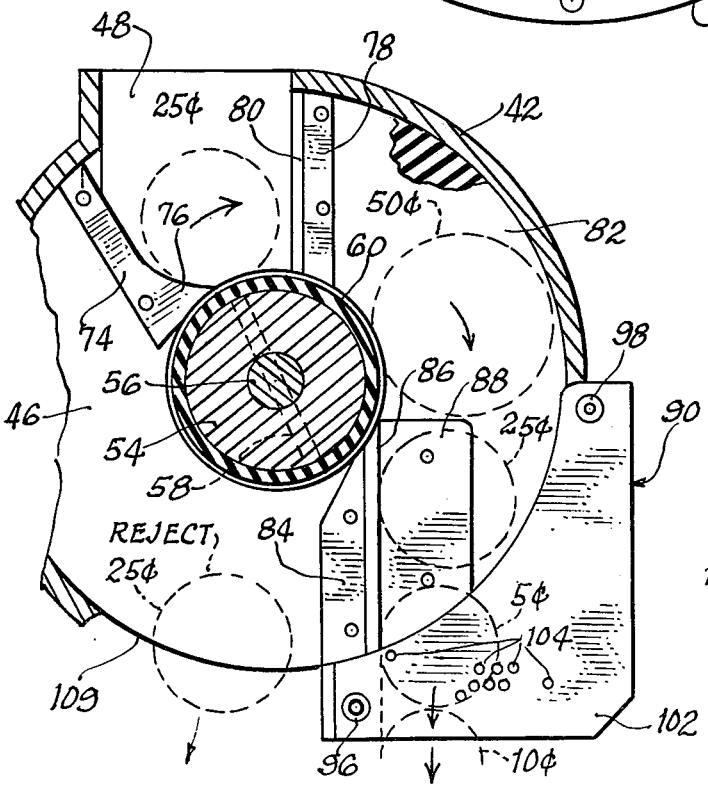

As best shown in FIG. 11, a guide member 74 is attached to the housing wall 46. This guide member includes an inturned end 76 which directs each check in one direction. A first ramp 78 defining a slope 80 is also secured to the wall 46. As illustrated in FIG. 3, the ramp 78 moves each check in the direction of the disc 52 whereby one face of each check is engaged by the rug 64. The opposite face of each check is engaged with the rubber surface 82 carried on the wall 46. The driving action imparted by the rug 64 serves to move each check up the slope 80 at which time the checks begin travel around the rubber sleeve 60 carried by the hub 54. Since the structure is inclined as shown in FIG. 4, the checks are automatically held against the rug to insure driving engagement.

Because of the fact that points on the disc 52 which are farther from the disc axis move at higher speeds, the checks move inwardly toward the axis, and an edge of each check is, therefore, automatically driven into engagement with this sleeve, and held in engagement as the check proceeds.

A second ramp 84 is also secured to the wall 46, and this ramp defines an engaging surface 86 which is substantially tangentially located relative to the periphery of the sleeve 60. Accordingly, each check moved by the disc 52 is brought into engagement with this surface 86. This engagement of the rug continues with a downward force component being included so that the checks move downwardly along the surface 86 with the direction of rotation serving to maintain the edge of each check firmly against the surface 86. A plate 88 attached to the wall 46 is inserted in a cutout area of the rubber mat 82 with this plate comprising a metal member or similar low friction surface whereby movement of the checks along the edge 86 is accelerated.

Figure 8:
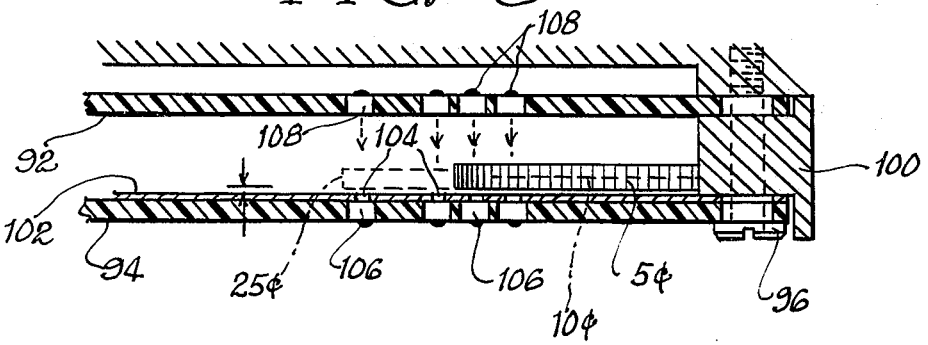
FIG. 8 is an enlarged fragmentary cross-sectional view illustrating detecting means and taken about the line 8—8 of FIG. 1.
Figure 9:
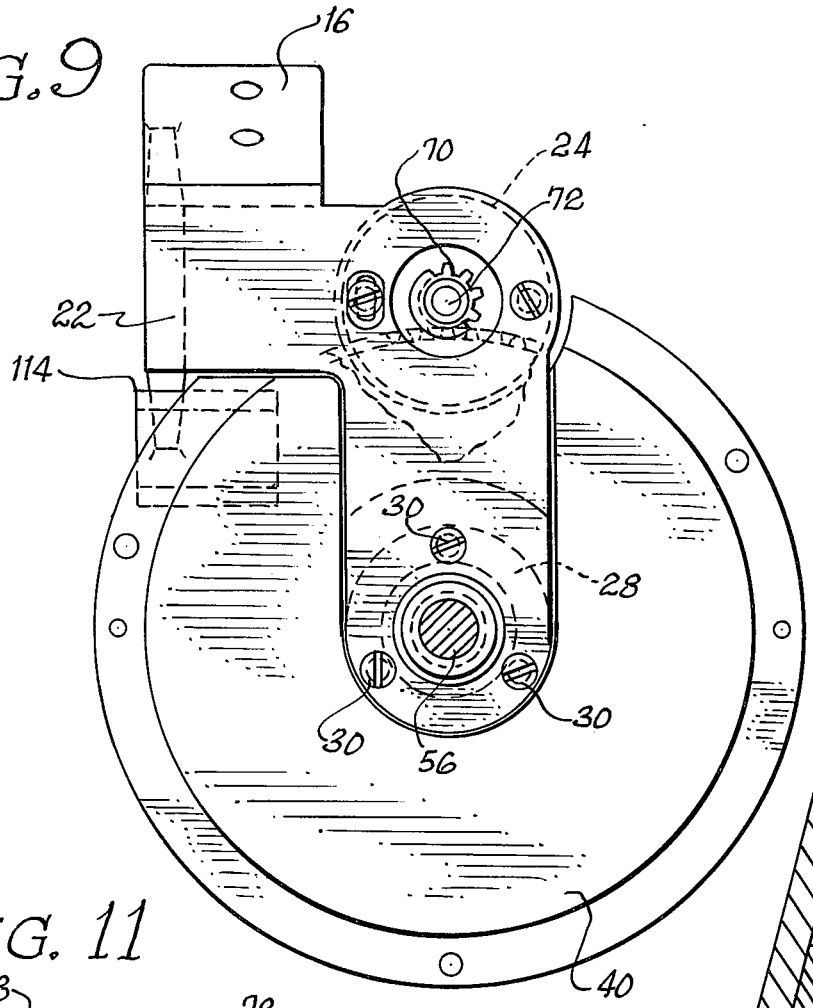
FIG. 9 is a cross-sectional view of the check receiving mechanism taken about the line 9—9 of FIG. 4.

A detecting mechanism 90 is positioned beyond the extent of housing 42 immediately adjacent the ramp 84. As best illustrated in FIG. 8, this mechanism includes a first printed circuit board 92, and the second printed circuit board 94. The mechanism is attached by means of screws 96 and 98 to the housing 42, and spacers 100 are provided for holding the circuit boards in suitable spaced relationship.

A mask 102 is preferably associated with the board 94 and held in assembly with the board by means of the screws 96 and 98. This mask defines small openings 104 which are aligned with phototransistors 106. Positioned in alignment on the board 92 are a corresponding number of light emitting diodes 108. By means of suitable connections on the printed circuit boards, the diodes are adapted to be energized and to develop signals by virtue of the phototransistors whereby suitable recording mechanisms can be activated. In conventional fashion, a trigger cell 109 detects the passage of a coin to initiate the recording operations.

Figure 7:
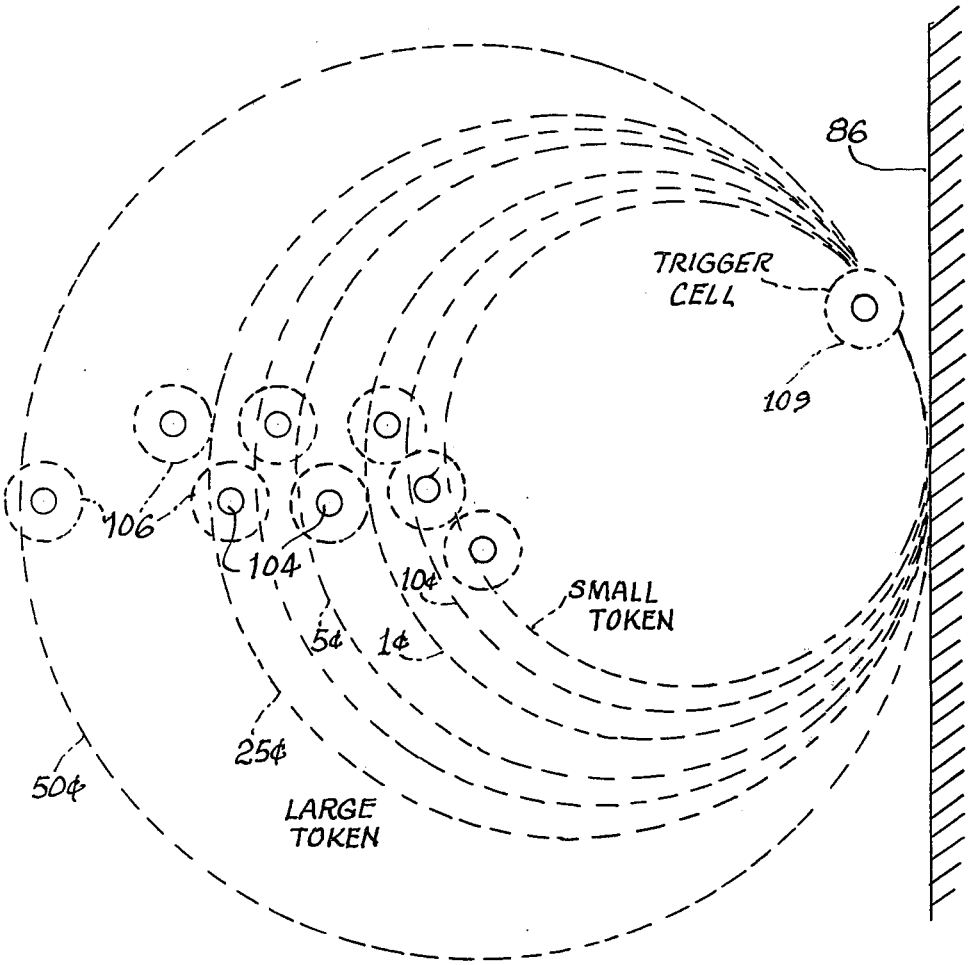
FIG. 7 is a schematic illustration of check detecting means suitable for use in the construction.

As shown in FIG. 7, the checks received in the construction may comprise large and small tokens and coins of the various denominations. The diodes and transistors are located so that the combination of transistors blocked by any particular check will result in the particular signal. The arrangement may be such that a value will be recorded for each check with the total value of the checks deposited by one individual being recorded and displayed for observance by personnel, for example, a bus operator. The system may also provide for the addition of this total to an accumulated amount of fares. More sophisticated arrangements may include a pair of transistors and diodes or comparable operating mechanisms for detecting each check of a particular diameter. The members of each pair can be slightly offset from each other to provide a "GO" and "NO GO" arrangement. Similarly, the logic of the system may be such that the insertion of a washer, the hole of which would create a different combination of signals, would lead to a rejection of the check and/or a warning signal. In addition, the logic should avoid recording of spurious checks which are rejected because of improper diameter or as washers.

Figure 10:
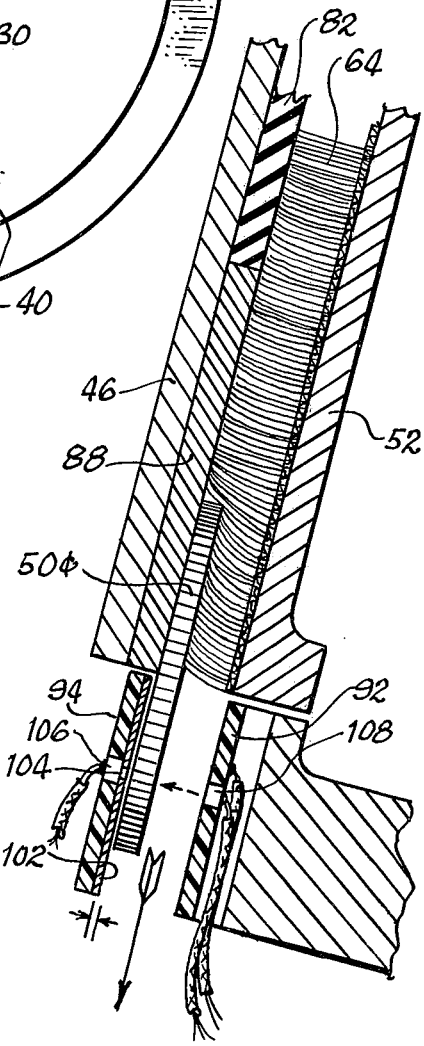
FIG. 10 is an enlarged fragmentary cross-sectional view taken about the line 10—10 of FIG. 1; and, FIG. 11 is a fragmentary cross-sectional view taken about the line 11—11 of FIG. 4.

As best shown in FIG. 10, the rug 64 continues to engage the checks when the checks are opposite the detecting elements. In the particular arrangement illustrated, the checks are only slightly spaced away from the stainless steel mask 102 while being substantially spaced from the printed circuit board 92. This particular relationship provides the desired detecting accuracy in this arrangement although it will be understood that other detecting means having comparable operating capabilities are clearly contemplated by the invention. Maintaining the slight spacing eliminates wear in the system which renders the described design particularly desirable.

Figure 5:
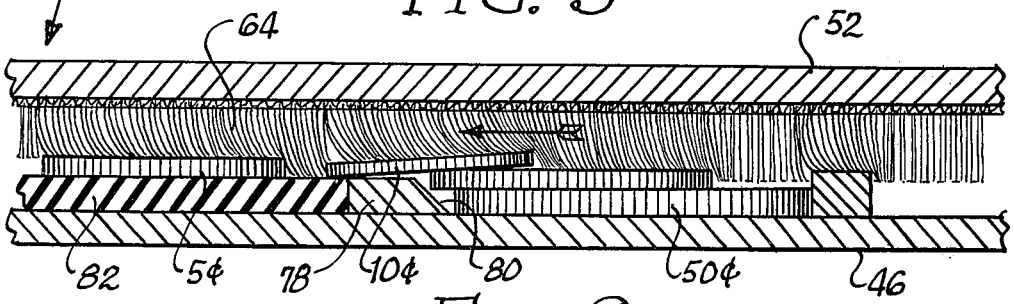
FIG. 5 is a cross-sectional view of the structure of FIG. 2 illustrating the movement of checks therethrough.

As noted, the system is of particular advantage because of the ability to move checks along the reference surface 86, one at a time, with none of the checks being stacked relative to each other so that accurate detection of each check can be achieved. In the operation of the system where a plurality of checks are inserted at the same time, the checks might be stacked as illustrated in FIG. 5. Under these circumstances, however, the movement of the rug 64 operates to drive the uppermost checks relative to an underlying check so that each check becomes separated from the other checks. The rug will separate some checks in the entry area prior to movement up the slope of ramp 78; however, if the checks are not separated at this point, they will be separated beyond the ramp. The provision of the rubber material 82 is of particular importance in this regard since this material will offer some resistance to sliding of a check when compared with the resistance offered by one check relative to another. Thus, the rug 64 and the surface 82 are designed so that the checks will separate in response to the rug movement as opposed to moving together under the influence of the rug.

It has been found that the motor 24 can be driven at very high speed whereby the checks are moved rapidly through the mechanism and along the reference surface 86. Due to the use of high speed recording mechanisms in association with the circuit boards, a handful of checks will be separated and counted in less than one second so that the collection function can be carried out in a transit system without in any way delaying passengers using the system.

Figure 6:
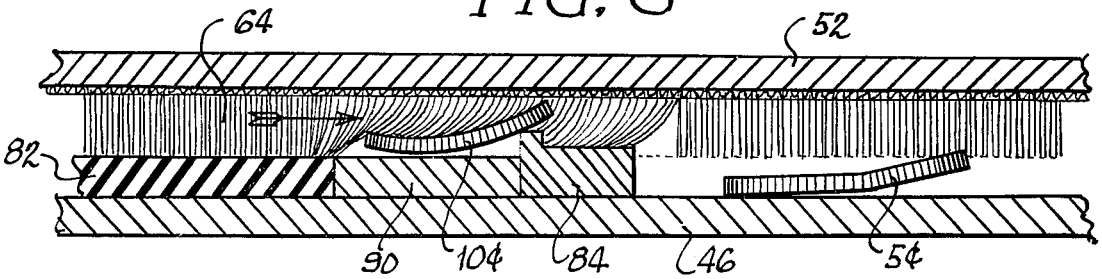
FIG. 6 is a cross-sectional view of the structure of FIG. 3 illustrating the manner of handling bent checks in the construction.

The arrangement of the invention provides for the by-passing of checks which are extremely distorted in shape. As best shown in FIG. 6, such checks are adapted to be swept by the rug 64 beyond the ramp 84 and into the area of wall 46 which is not covered by the mat 82. A suitable chute may be employed for such checks to return them to the person making the deposit. As shown, a gap is formed in the housing 42 at 109 which may communicate with such a chute.

If a distorted check or checks, which for some reason will not unstack, jam between the disc 52 and wall 46, the mechanism including spring 36 will operate to relieve this jam. Thus, the wall 46 will back away from the disc 42 as shown in dotted lines in FIG. 4, and this will permit rotation of the disc 52 until sufficient movement is achieved to relieve the jam.

A manual unjamming means is provided through the use of a yoke 110. This yoke is attached to rod 112 which extends through the cylinder 114 formed integrally with bracket 16. This rod may be attached to a handle externally of the housing 10 whereby rotation of the handle will move the yoke 110. The yoke includes a pair of downwardly extending arms 116, one of which is illustrated in FIG. 4. Each arm carries an inwardly extending pin 118 which is received within groove 120 defined by the hub 34. When the rod 112 is rotated in a clockwise direction as shown in FIG. 4, the pins will move the hub 34 for wall 46 with the latter shifting to the dotted line position illustrated. This then increases the clearance between the wall and disc 52 to relieve any jamming, and it will be noted that the gear 66 continues to rotate under these circumstances.

It will be understood that various changes and modifications may be made in the above described apparatus without departing from the spirit thereof, particularly as defined in the following claims.

That which is claimed is:

1. In an apparatus adapted to receive checks including coins, tokens and the like wherein detecting means are provided for inspection of the checks, the improvement comprising means for receiving the checks and separating means for the checks whereby the checks are moved one at a time to the detecting means, said separating means comprising a first engaging surface for engaging one side of said checks, a second engaging surface positioned in spaced relationship with said first surface for engaging the opposite side of said checks, drive means for driving at least one of said surfaces relative to the other surface whereby checks in overlying relationship are engaged one by the first surface and the other by the second surface to separate the checks one from the other due to movement of the one check relative to the other check, a barrier ramp positioned at least partially between said surfaces, said ramp being positioned in spaced relationship to the position of said means for receiving the checks, separated checks being driven one at a time into engagement with said ramp, said detecting means comprising means for measuring the diameter of said checks while they are in engagement with the ramp.

2. An apparatus in accordance with claim 1 wherein said first surface is defined by a disc member, said drive means being connected to said disc member.

3. An apparatus in accordance with claim 2 wherein said disc means carries a rug-like material comprising a pile adapted to engage checks and to move the checks therewith.

4. An apparatus in accordance with claim 3 wherein said second surface comprises a rubber material, said second surface being provided on a member normally held stationary whereby said disc member is rotated relative to the second surface.

5. An apparatus in accordance with claim 4 including a supporting plate for said stationary member, spring means normally urging said stationary member toward said disc member, said stationary member being movable away from said disc member in opposition to said spring means upon forcing of objects between said surfaces which are of undue thickness relative to the normal spacing between said surfaces.

6. An apparatus in accordance with claim 5 including manually operable means accessible from the exterior of the apparatus and connected to said plate for manually forcing said stationary member away from said disc means.

7. An apparatus in accordance with claim 2 wherein said disc means defines a central hub portion, the rotation of the disc means normally driving the edge of each check against said hub portion.

8. An apparatus in accordance with claim 7 wherein said ramp defines a surface beginning adjacent to and tangent to said hub portion whereby checks are driven from engagement with said hub portion into engagement with said ramp, and wherein said detecting means are located adjacent said ramp outside the perimeter of said disc member.

9. An apparatus in accordance with claim 1 wherein said measuring means comprise a plurality of light transmitting means located in progressive spaced relationship away from said ramp and positioned on one side of checks engaged with said ramp, a plurality of light detecting means located in progressive spaced relationship away from said ramp on the opposite side of checks engaged with the ramp, and means connected to said light detecting means for recording the detection of light beams from said light transmitting means whereby different recordings are made depending upon the size of checks engaged with said ramp.

10. An apparatus in accordance with claim 1 wherein said separating means and detecting means are mounted in the housing of a farebox, said first and second surfaces being defined by spaced-apart plates, said farebox defining a check receiving throat communicating with the space between said plates for the passage of said checks from the throat into said space.

11. An apparatus in accordance with claim 10 wherein said checks are moved in a substantially vertical path from said throat into said space, said plates being inclined relative to the vertical.

12. An apparatus in accordance with claim 11 wherein one of said plates comprises a disc member, said drive means being connected to said disc member.

13. An apparatus in accordance with claim 12 wherein said disc means carries a rug-like material comprising a pile adapted to engage checks and to move the checks therewith.

14. An apparatus in accordance with claim 13 wherein said second surface comprises a rubber material, said second surface being provided on a member normally held stationary whereby said disc member is rotated relative to the second surface.

15. An apparatus in accordance with claim 14 wherein said disc means defines a central hub portion, the rotation of the disc means normally driving the edge of each check against said hub portion.

16. An apparatus in accordance with claim 15 including a sleeve of rubber carried by said hub portion for engagement by the edges of said checks.

17. An apparatus in accordance with claim 10 including means resiliently urging said plates together whereby the spacing between the plates is adapted to increase in the event of the jamming of checks between the plates.

18. A construction in accordance with claim 17 wherein manually operated means are associated with at least one plate for movement in opposition to said resilient means for thereby manually relieving jams.

19. An apparatus in accordance with claim 1 wherein said ramp extends outwardly beyond said surfaces, said detecting means being located beyond said surfaces and said ramp guiding said checks to said detecting means.

20. In an apparatus adapted to receive checks including coins, tokens and the like wherein detecting means are provided for inspection of the checks, the improvement comprising means for receiving the checks and separating means for the checks whereby the checks are moved one at a time to the detecting means, said separating means comprising a first engaging surface for engaging one side of said checks, a second engaging surface positioned in spaced relationship with said first surface for engaging the opposite side of said checks, said first and second surfaces being defined by substantially parallel, spaced-apart plates, drive means for driving at least one of said plates relative to the other whereby checks in overlying relationship are engaged one by the first surface and the other by the second surface to separate the checks one from the other due to movement of the one check relative to the other check, and a guide means located between said plates, said guide means defining a check edge-engaging surface spaced inwardly of the peripheries of the plates and limiting the inward movement of the checks, the operation of the drive means normally driving the edge of each check against said guide means, said guide means defining a guide surface comprising an elongated extension of said check edge-engaging surface, said extension being directed outwardly of said plates, said drive means driving the check along said guide surface whereby the checks are removed one at a time from between said plates.

21. An apparatus in accordance with claim 20 wherein one of said plates comprises a disc means carrying a rug-like material comprising a pile adapted to engage checks and to move the checks therewith, said drive means being connected to said disc means.

22. An apparatus in accordance with claim 21 wherein said second surface on the other plate comprises a rubber material, said other plate being normally held stationary whereby said disc member is rotated relative to the second surface.

23. An apparatus in accordance with claim 20 wherein said detecting means comprise means for measuring the diameter of said checks.

24. An apparatus in accordance with claim 20 wherein said separating means and detecting means are mounted in the housing of a farebox, said farebox defining a check receiving throat communicating with the space between said plates for the passage of said checks from the throat into said space.

25. An apparatus in accordance with claim 24 wherein said checks are moved in a substantially vertical path from said throat into said space, said plates being inclined relative to the vertical.

26. An apparatus in accordance with claim 25 wherein one of said plates comprises a disc member, said drive means being connected to said disc member.

27. An apparatus in accordance with claim 26 wherein said disc means carries a rug-like material comprising a pile adapted to engage checks and to move the checks therewith.

28. An apparatus in accordance with claim 27 wherein said second surface on the other plate comprises a rubber material, said other plate being normally held stationary whereby said disc member is rotated relative to the second surface.

29. An apparatus in accordance with claim 28 wherein said disc means defines a central hub portion, the rotation of the disc means normally driving the edge of each check against said hub portion, said hub portion defining said check edge-engaging surface.

30. An apparatus in accordance with claim 29 including a sleeve of rubber carried by said hub portion for engagement by the edges of said checks.

31. In an apparatus adapted to receive checks including coins, tokens and the like wherein detecting means are provided for inspection of the checks, the improvement comprising means for receiving the checks and separating means for the checks whereby the checks are moved one at a time to the detecting means, said separating means comprising a first engaging surface for engaging one side of said checks, a second engaging surface positioned in spaced relationship with said first surface for engaging the opposite side of said checks, said first and second surfaces being defined by substantially parallel, spaced-apart plates, drive means for driving at least one of said plates relative to the other whereby checks in overlying relationship are engaged one by the first surface and the other by the second surface to separate the checks one from the other due to movement of the one check relative to the other check, one of said plates comprising a disc means carrying a rug-like material comprising a pile adapted to engage checks and to move the checks therewith, said drive means being connected to said disc means, said second surface on the other plate comprising a rubber material, said other plate being normally held stationary whereby said disc member is rotated relative to the second surface, spring means normally urging said other plate toward said disc member, said other plate being movable away from said disc member in opposition to said spring means upon forcing of objects between said surfaces which are of undue thickness relative to the normal spacing between said surface, and a guide means located between said plates, the operation of the drive means normally driving the edge of each check against said guide means, said guide means defining a guide surface directed outwardly of said plates, said drive means driving the check along said guide surface whereby the checks are removed one at a time from between said plates.

32. An apparatus in accordance with claim 31 including manually operable means accessible from the exterior of the apparatus and connected to said other plate for manually forcing said other plate away from said disc means.

33. In an apparatus adapted to receive checks including coins, tokens and the like wherein detecting means are provided for inspection of the checks, the improvement comprising means for receiving the checks and separating means for the checks whereby the checks are moved one at a time to the detecting means, said separating means comprising a first engaging surface for engaging one side of said checks, a second engaging surface positioned in spaced relationship with said first surface for engaging the opposite side of said checks, said first and second surfaces being defined by substantially parallel, spaced-apart plates, drive means for driving at least one of said plates relative to the other whereby checks in overlying relationship are engaged one by the first surface and the other by the second surface to separate the checks one from the other due to movement of the one check relative to the other check, and a guide means located between said plates, the operation of the drive means normally driving the edge of each check against said guide means, said guide means defining a guide surface directed outwardly of said plates, said drive means driving the check along said guide surface whereby the checks are removed one at a time from between said plates, said detecting means comprising means for measuring the diameter of said checks, said guide means comprising a ramp, said measuring means comprising a plurality of light transmitting means located in progressive spaced relationship away from said ramp and positioned on one side of checks engaged with said ramp, a plurality of light detecting means located in progressive spaced relationship away from said ramp on the opposite side of checks engaged with the ramp, and means connected to said light detecting means for recording the detection of light beams from said light transmitting means whereby different recordings are made depending upon the size of checks engaged with said ramp.

34. In a farebox apparatus adapted to receive checks including coins, tokens and the like wherein detecting means are provided for inspection of the checks, the improvement comprising means for receiving the checks and separating means for the checks whereby the checks are moved one at a time to the detecting means, said separating means comprising a first engaging surface for engaging one side of said checks, a second engaging surface positioned in spaced relationship with said first surface for engaging the opposite side of said checks, said first and second surfaces being defined by substantially parallel, spaced-apart plates, a check receiving throat defined by the farebox and communicating with the space between said plates for the passage of said checks from the throat into said space, drive means for driving at least one of said plates relative to the other whereby checks in overlying relationship are engaged one by the first surface and the other by the second surface to separate the checks one from the other due to movement of the one check relative to the other check, one of said plates comprising a disc means carrying a rug-like material comprising a pile adapted to engage checks and to move the checks therewith, said drive means being connected to said disc means, said second surface on the other plate comprising a rubber material, said other plate being normally held stationary whereby said disc member is rotated relative to the second surface, spring means normally urging said other plate toward said disc member, said other plate being movable away from said disc member in opposition to said spring means upon forcing of objects between said surfaces which are of undue thickness relative to the normal spacing between said surfaces, and a guide means located between said plates, the operation of the drive means normally driving the edge of each check against said guide means, said guide means defining a guide surface directed outwardly of said plates, said drive means driving the check along said guide surface whereby the checks are removed one at a time from between said plates.

35. A construction in accordance with claim 34 wherein manually operated means are associated with at least one plate for movement in opposition to said resilient means for thereby manually relieving jams.

* * * * *